US008430485B2

(12) United States Patent
Koizumi

(10) Patent No.: US 8,430,485 B2
(45) Date of Patent: Apr. 30, 2013

(54) LIQUID EJECTING APPARATUS

(75) Inventor: Yoshihiro Koizumi, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 85 days.

(21) Appl. No.: 13/211,214

(22) Filed: Aug. 16, 2011

(65) Prior Publication Data

US 2012/0044304 A1 Feb. 23, 2012

(30) Foreign Application Priority Data

Aug. 17, 2010 (JP) ..... 2010-182123

(51) Int. Cl.
*B41J 2/175* (2006.01)

(52) U.S. Cl.
USPC ..... 347/85; 347/89

(58) Field of Classification Search ..... 347/84, 347/85, 86, 87, 89
See application file for complete search history.

(56) References Cited

U.S. PATENT DOCUMENTS

| | | | | |
|---|---|---|---|---|
| 4,432,005 | A * | 2/1984 | Duffield et al. | 347/86 |
| 6,116,727 | A * | 9/2000 | Hagiwara | 347/89 |
| 6,213,601 | B1 * | 4/2001 | Akuzawa et al. | 347/89 |
| 7,883,187 | B2 * | 2/2011 | Kawase | 347/84 |
| 8,240,832 | B2 * | 8/2012 | Anno et al. | 347/89 |

FOREIGN PATENT DOCUMENTS

JP 2005-066520 A 3/2005

* cited by examiner

*Primary Examiner* — Anh T. N. Vo
(74) *Attorney, Agent, or Firm* — Kilpatrick Townsend & Stockton LLP

(57) ABSTRACT

A liquid-feeding pump that feeds liquid, which is sucked out from a liquid container, into an ejection nozzle is provided. In addition, a circulation pump that discharges the liquid, which is sucked out from the liquid container, to the liquid container is provided. Moreover, a decompression pump, which generates a pressure for operating the liquid-feeding pump, is used as a drive source of the circulation pump. Therefore, a driving mechanism for the circulation pump need not be additionally provided. Accordingly, it is possible to simplify a configuration of a liquid ejecting apparatus while being capable of agitating the inner portion of the liquid container by using the circulation pump.

3 Claims, 8 Drawing Sheets

LIQUID EJECTING APPARATUS

This application claims priority to Japanese Patent Application No. 2010-182123, filed Aug. 17, 2010, the entirety of which is incorporated by reference herein.

BACKGROUND

1. Technical Field

The present invention relates to a liquid ejecting apparatus that ejects a liquid from an ejection head.

2. Related Art

In a so-called ink jet printer, it is possible to print a high quality image by ejecting a correct amount of ink to correct positions from fine ejection nozzles. In addition, by using the technology, when ejecting various liquids instead of the ink toward a substrate, electrodes, sensors, bio-chips, or the like can also be manufactured.

The liquid ejected from the ejection nozzles is supplied from a liquid container (for example, an ink cartridge) which stores the liquid. In addition, as a liquid which is stored in the liquid container, the liquid including pigment or the like, for example, a component (a component having a sedimentation property) having greater specific weight than that of solvent, is used. Moreover, in the liquid (the liquid having the sedimentation property), a solute in the liquid is sedimented in the gravity direction over time. When the liquid is supplied to the ejection nozzle in the above state, unevenness in the concentration of the liquid ejected occurs, or the concentration of the liquid is increased. Therefore, adverse effects such as a blockage of a pathway due to the thickened liquid occur. Thus, a technology is suggested in which an agitator is installed in the inner portion of the liquid container and the above-described adverse effect, which is occurs due to the sedimentation, is suppressed by driving the agitator and agitating the liquid in the liquid container (JP-A-2005-66520).

However, in the above-described technology of the related art, since a driving mechanism for driving the agitator needs to be additionally provided, there is a problem in that the liquid ejecting apparatus may be complicated.

SUMMARY

An advantage of some aspects of the invention is to provide a technology capable of agitating a liquid in a liquid container without complicating a liquid ejecting apparatus.

According to an aspect of the invention, there is provided a liquid ejecting apparatus that ejects a liquid from an ejection nozzle, the liquid ejecting apparatus including: a liquid container that stores the liquid to be supplied to the ejection nozzle; a liquid-feeding pump that feeds the liquid, which is sucked out from the liquid container, into the ejection nozzle; a decompression pump that generates pressure for operating the liquid-feeding pump; a circulation pathway in which both ends of the circulation pathway are opened to the liquid container; and a circulation pump that is provided in the circulation pathway, discharges the liquid sucked out from the liquid container to the liquid container, and is operated by the pressure generated through the decompression pump.

According to the liquid ejecting apparatus of the aspect of the invention, by operating the liquid-feeding pump, the liquid in the liquid container is supplied to the ejection nozzle. In addition, if operating the circulation pump, the liquid, which is sucked out from the liquid container to the circulation pathway, is discharged from the circulation pathway to the liquid container. Therefore, the liquid in the liquid container is agitated. Thus, the circulation pump is operated by the decompression pump that is provided for operating the liquid-feeding pump. In addition, as the liquid-feeding pump and the circulation pump, for example, a diaphragm pump can be appropriately used.

Thereby, the circulation pump can also be operated by using the decompression pump that is for operating the liquid-feeding pump. Therefore, it is possible to simplify the configuration of the liquid ejecting apparatus while being capable of agitating the inner portion of the liquid container by using the circulation pump. Moreover, since the liquid-feeding pump and the circulation pump are operated by the same decompression pump, if operating the liquid-feeding pump (that is, if supplying the liquid to the ejection nozzle), the circulation pump is also operated (the liquid in the liquid container is agitated). As a result, even without performing a specific control, it is possible to eject the liquid while agitating the inner portion of the liquid container. Therefore, it is possible to effectively suppress the adverse effect which occurs due to the fact that components having a sedimentation property are sedimented in the liquid container.

Moreover, in the liquid ejecting apparatus, first, both ends of the circulation pathway may be opened at different heights in the liquid container. In addition, by using the circulation pump, the liquid in the liquid container may be sucked out from the side opened to the lower end and the liquid may be discharged into the liquid container from the side opened to the higher end. In addition, from an intermediate height (the intermediate height is higher than the opening of the lower side and lower than the opening of the higher side) of positions in which both ends of the circulation pathway are opened to the liquid container, by using the liquid-feeding pump, the liquid may be sucked out and may be fed to the ejection nozzle.

According to the above configuration, for the following reasons, it is possible to finish up the liquid without wasting the liquid in the liquid container while efficiently agitating the liquid in the liquid container. First, since the liquid sucked up from the lower position of the liquid container is discharged from the higher position of the liquid container, for example, even in a state where components having the sedimentation property are accumulated in the vicinity of the bottom surface of the liquid container, it is possible to efficiently agitate by sucking out the components having the sedimentation property and discharging the components from above. In addition, a position (a sucking-out position of the liquid-feeding pump) in which the liquid-feeding pump sucks out the liquid for feeding the liquid to the ejection head is positioned higher than a position (a sucking-out position of the circulation pump) in which the circulation pump sucks out the liquid in the liquid container for circulating the liquid. Generally, from the viewpoint of sucking out the liquid without wasting the liquid in the liquid container, it is preferable that the liquid is sucked out from the downside of the liquid container as much as possible. Accordingly, it is not preferable in terms of sucking-out the liquid without wasting the liquid that the sucking-out position of the liquid-feeding pump is positioned higher than the sucking-out position of the circulation pump. However, after the liquid which the circulation pump sucks out is discharged into the liquid container from higher positions, the liquid flows in the liquid container up to a position at which the liquid-feeding pump sucks out the liquid, and is dropped. That is, the liquid, which is positioned at the position which is lower than the position (the sucking-out position of the liquid-feeding pump) in which the liquid-feeding pump sucks out the liquid in the liquid container, is sucked up by the circulation pump, and the liquid can be delivered up to the sucking-out position of the liquid-feeding pump. Therefore, even when the remaining amount of the liquid in the liquid container becomes small, it is possible to suck out the liquid without wasting the liquid in the liquid container.

In addition, in the liquid ejection apparatus of the invention, any one of the liquid-feeding pump or the circulation pump may be operated by the negative pressure which is generated by the decompression pump, the other one may be operated by the pressure of the air which is discharged from the decompression pump according to the generation of the negative pressure by the decompression pump.

Since the negative pressure is generated due to the fact that the decompression pump sucks out the air, the decompression pump necessarily discharges the air if the negative pressure is generated. In addition, as the number of the liquid-feeding pumps or the circulation pumps which are operated is increased, the amount of the air which the decompression pump discharges is also increased. Therefore, without operating all of the liquid-feeding pumps and the circulation pumps by the negative pressure, when half of the liquid-feeding pumps and the circulation pumps (or a part of them) are operated by the pressure of the air discharged from the decompression pump, the number of the pumps (the liquid-feeding pumps and the circulation pumps) in which the decompression pump is driven by using the negative pressure becomes small. As a result, it is possible to decrease the volume of the decompression pump, and the miniaturization of the liquid ejecting apparatus can be achieved.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, in order to clarify the contents of the invention described above, embodiments will be described according to order below.

A. Apparatus Configuration

Figure 1:
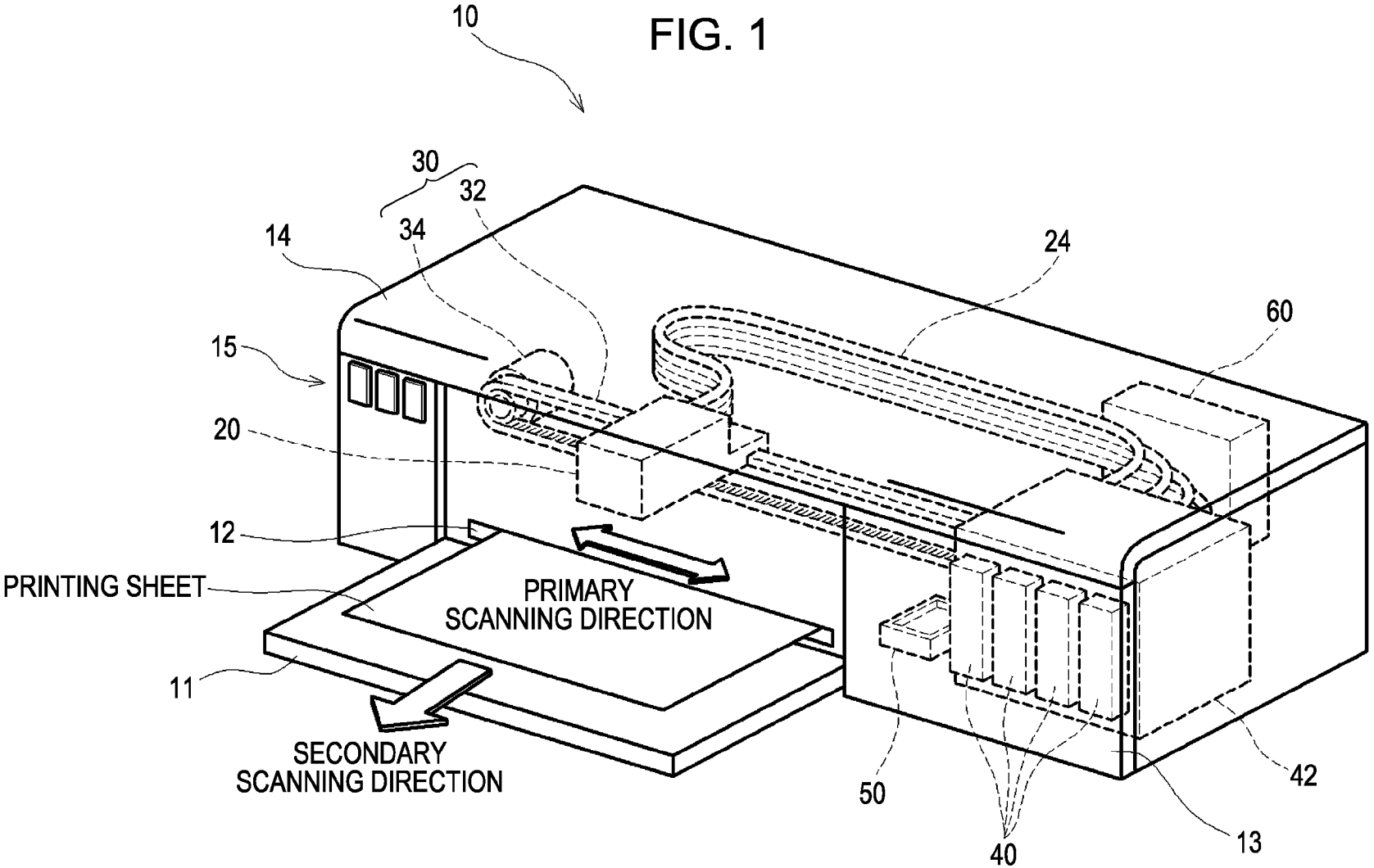
FIG. 1 is an explanatory view showing a configuration of an ink jet printer.

B. Driving Mechanism of Circulation Pump and Liquid-feeding Pump of The Present Embodiment C. Modification C-1: First Modification C-2: Second Modification A. Apparatus Configuration FIG. 1 is an explanatory view showing a schematic configuration of a liquid ejecting apparatus of the present embodiment which uses a so-called ink jet printer as an example. The ink jet printer 10 has an appearance configuration of an approximate box-shape, a front cover 11 is provided in an approximate center of the front surface of the ink jet printer 10, and a plurality of operation buttons 15 is provided in the left of the ink jet printer. The front cover 11 is pivotally supported in the lower end side of the front cover 11, and an elongated sheet-discharging opening 12 in which a printing sheet is discharged is revealed if the upper end side of the front cover 11 is turned over toward the front. In addition, in the rear surface side of the ink jet printer 10, a sheet-feeding tray (not shown) is provided. When setting the printing sheet in the sheet-feeding tray and operating an operating button 15, the printing sheet is sucked in from the sheet-feeding tray, and the printing sheet is discharged from the sheet-discharging opening 12 after printing an image or the like on the surface of the printing sheet in the inner portion of the ink jet printer.

In addition, an upper surface cover 14 is provided in the upper surface side of the ink jet printer 10. The upper surface cover 14 is pivotally supported in the inner side of the cover. When lifting the front side of the upper surface cover 14 and opening the upper surface cover 14, it is possible to identify the condition of the inner portion of the ink jet printer 10 or perform repair or the like of the ink jet printer 10.

In addition, in the inner portion of the ink jet printer 10, an ejection head 20 that forms ink dots on the printing sheet while reciprocating in a primary scanning direction, or a driving mechanism 30 that reciprocates the ejection head 20, and the like are mounted. A plurality of ejection nozzles is provided in a bottom surface side (a side which faces the printing sheet) of the ejection head 20, and ink is ejected from the ejection nozzles toward the printing sheet.

In addition, the ink ejected from the ejection nozzles is received in containers which are referred to as ink cartridges 40 and are designed for storage. The ink cartridges 40 is mounted on a cartridge holder 42 that is installed at a position other than the position of the ejection head 20, and the ink in the ink cartridges 40 is supplied to the ejection head 20 via ink tubes 24. In the ink jet printer 10 of the embodiment, a cartridge exchanging cover 13 which is pivotally supported in the lower end side of the cover 13 is installed in the right of the front cover 11. In addition, the ink cartridges 40 are attached and detached to the cartridge holder 42 by turning over the upper end side of the cartridge exchanging cover 13 toward the front.

Moreover, in the ink jet printer 10, it is possible to print color images by using inks of four colors of cyan, magenta, yellow, and black. According to this, the ejection nozzles are installed in the ejection head 20 for each kind of the inks. Moreover, the inks in the corresponding ink cartridges 40 are supplied to the respective ejection nozzles via the ink tubes 24 which are installed for each kind of the inks.

The driving mechanism 30 that reciprocates the ejection head 20 includes: a timing belt 32 in which a plurality of teeth is formed therein; a driving motor 34 for driving the timing belt 32; and the like. A portion of the timing belt 32 is fixed to the ejection head 20. If the timing belt 32 is driven, it is possible to reciprocate the ejection head 20 in the primary scanning direction while guiding the ejection head by a guide rail (not shown) that is extended and installed in the primary scanning direction.

In addition, in a position that is other than a printing area in which the ejection head 20 moves in the primary scanning direction, a region referred to as a home position is provided. A maintenance mechanism is mounted on the home position. At the bottom side (the side which faces the printing sheet) of the ejection head 20, the maintenance mechanism is pressed to a surface (a nozzle surface) in which the ejection nozzles are formed. The maintenance mechanism includes: a cap 50 that forms an enclosed space so as to enclose the ejection nozzles; a lifting and lowering mechanism (not shown) that lifts and lowers the cap 50 so as to press the cap to the nozzle surface of the ejection head 20; a suction pump (not shown) that introduces a negative pressure to the enclosed space formed by pressing the cap 50 to the nozzle surface of the ejection head 20; and the like.

In addition, in the inner portion of the ink jet printer 10, a sheet-feeding mechanism (not shown) for feeding the printing sheet, a control portion 60 that controls all operations of the ink jet printer 10, and the like are mounted. An operation that reciprocates the ejection head 20, an operation that feeds the printing sheet, an operation that ejects the ink from the ejection nozzles, an operation that performs the maintenance so as to print normally, and the like are controlled by the control portion 60.

Figure 2:
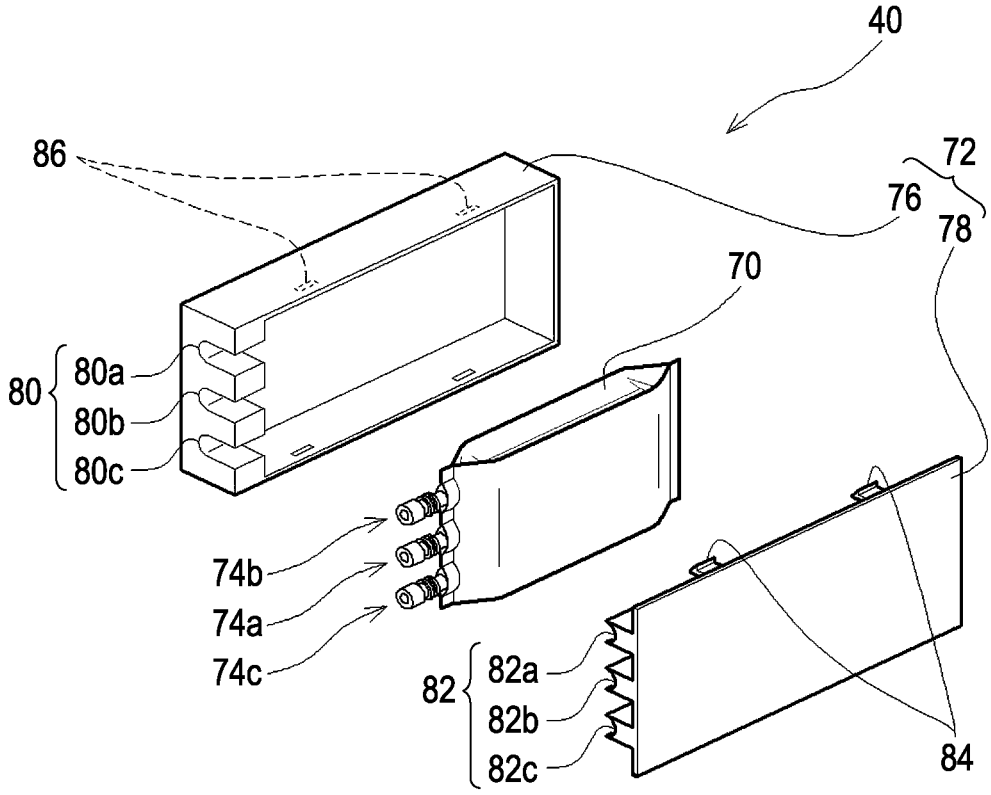
FIG. 2 is an exploded perspective view showing a configuration of an ink cartridge of the present embodiment.

FIG. 2 is an exploded perspective view showing a configuration of the ink cartridge 40 of the embodiment. The ink cartridges 40 includes an ink pack 70 that receives ink, a cartridge case 72 that houses the ink pack 70, and the like. In the ink pack 70, an ink supplying port 74*a* for supplying the ink to the ejection head 20 is provided in an edge portion of the ink pack 70 in the front side of the sheet surface. In addition, in the ink pack 70 of the embodiment, an ink suction port 74*c* is provided slightly below the ink supplying port 74*a*, and the ink sucked from the ink suction port 74*c* is flowed back from an ink discharging port 74*b*, which is installed slightly above the ink supplying port 74*a*, to inside the ink pack 70. A mechanism for flowing back the ink and the reason for flowing back the ink are described below.

The cartridge case 72 that houses the ink pack 70 includes a main body case 76 and a cover 78. The main body case 76 having a box-shape can house the ink pack 70 in the inner portion of the main body case. On the other hand, the cover 78 having a plate-shape is a member that seals (serves as a cover) an opening of the main body case 76. The main body case 76 and the cover 78 are joined to each other by engaging hooks 84 installed in the cover 78 to recesses 86 installed in the main body case 76.

In addition, in order to cause the ink supplying port 74*a* to protrude, the ink discharging port 74*b* and the ink suction port 74*c* of the ink pack 70 housed in the main body case 76 to the outside of the main body case 76, notches 80 are provided in the main body case 76. Moreover, pressing portions 82, which press the ink supplying port 74*a* and the like fitted to the notches 80, are provided in the cover 78. Accordingly, in a state of housing the ink pack 70 in the main body case 76, if sealing the opening of the main body case 76 by the cover 78, the ink supplying port 74*a* interposed between a notch 80*a* of the main body case 76 and a pressing portion 82*a* is fixed, the ink discharging port 74*b* interposed between a notch 80*b* and a pressing portion 82*b* is fixed, and the ink suction port 74*c* interposed between a notch 80*c* and a pressing portion 82*c* is fixed.

Figure 3:
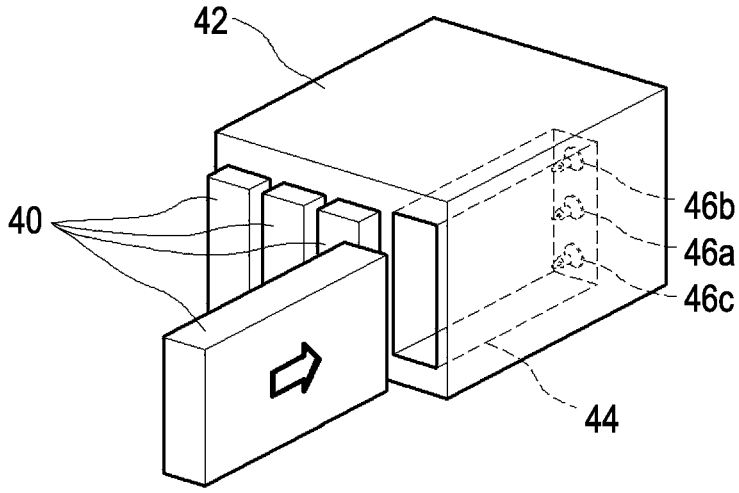
FIG. 3 an explanatory view showing an appearance in which ink cartridges are mounted to a cartridge holder.

FIG. 3 an explanatory view showing an appearance in which the ink cartridges 40 are mounted on the cartridge holder 42. Inserting holes 44, which insert the ink cartridges 40 from the front side to the back side, are provided in the cartridge holder 42 for each ink cartridge 40. In the surfaces of the back sides of the inserting holes 44, three needles (an ink supplying needle 46*a*, an ink discharging needle 46*b*, and an ink suction needle 46*c*) for connecting the ink cartridge 40 to an inner portion mechanism of the cartridge holder 42 described hereinafter are provided. If inserting the ink cartridge 40 until the back side of the inserting hole 44, the ink supplying needle 46*a* is inserted to the ink supplying port 74*a* of the ink cartridge 40 side, the ink discharging needle 46*b* is inserted to the ink discharging port 74*b*, and the ink suction needle 46*c* is inserted to the ink suction port 74*c*. In addition, an ink agitating mechanism is provided in the cartridge holder 42 of the embodiment as follows.

Figure 4:
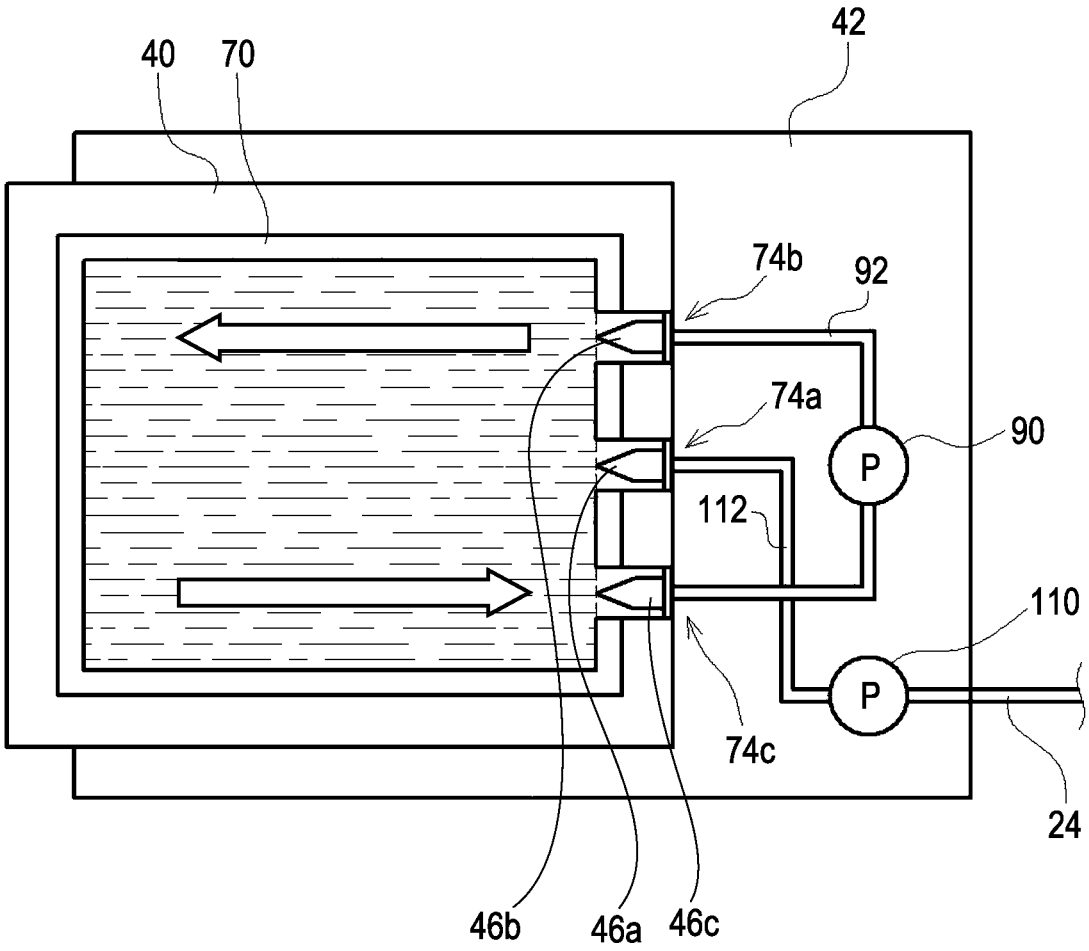
FIG. 4 is an explanatory view showing an ink agitating mechanism in the cartridge holder.

FIG. 4 is an explanatory view showing an ink agitating mechanism provided in the cartridge holder 42. In FIG. 4, in a state of mounting the ink cartridge 40 on the cartridge holder 42, the appearances of the inner portions of the ink cartridge 40 and the cartridge holder 42 are shown. In addition, as described above, in the ink jet printer 10 of the embodiment, the ink cartridges 40 of four colors of cyan, magenta, yellow, black are mounted. According to this, the mechanism for agitating the ink is installed in the inner portion of the cartridge holder 42 for each ink cartridge 40. However, in order to avoid complicating the drawings, in FIG. 4, the mechanism for agitating the ink in a certain ink cartridge is shown representatively.

As shown in FIG. 4, in the state of mounting the ink cartridge 40 on the cartridge holder 42, the ink supplying port 74*a* installed in the middle portion of the ink cartridge 40 is connected to the ink tube 24 of the back surface of the cartridge holder 42 via a supplying pathway 112 in the cartridge holder 42. Moreover, a liquid-feeding pump 110 is installed in the supplying pathway 112, the ink is sucked out from the ink cartridge 40 by driving the liquid-feeding pump 110, and the sucked-out ink is supplied to the ejection head 20 via the ink tube 24.

In addition, the ink discharging needle 46*b* installed in the upper portion of the cartridge holder 42 and the suction needle 46*c* installed in the lower portion are connected to each other via a circulation pathway 92 in the cartridge holder 42, and a circulation pump 90 is installed in the circulation pathway 92. If driving the circulation pump 90, the ink is sucked out from the ink suction port 74*c* of the ink cartridge 40, and the sucked-out ink is discharged to the ink discharging port 74*b* via the ink circulation pathway 92. Therefore, as shown by an arrow in FIG. 4, the ink flow flowed in the ink suction port 74*c* and the ink flow discharged from the ink discharging port 74*b* are generated, and the ink in the ink cartridge 40 is agitated by the above flows. In addition, the liquid-feeding pump 110 and the circulation pump 90 of the embodiment are diaphragm pumps and these diaphragm pumps are driven by a mechanism described below.

Figure 5:
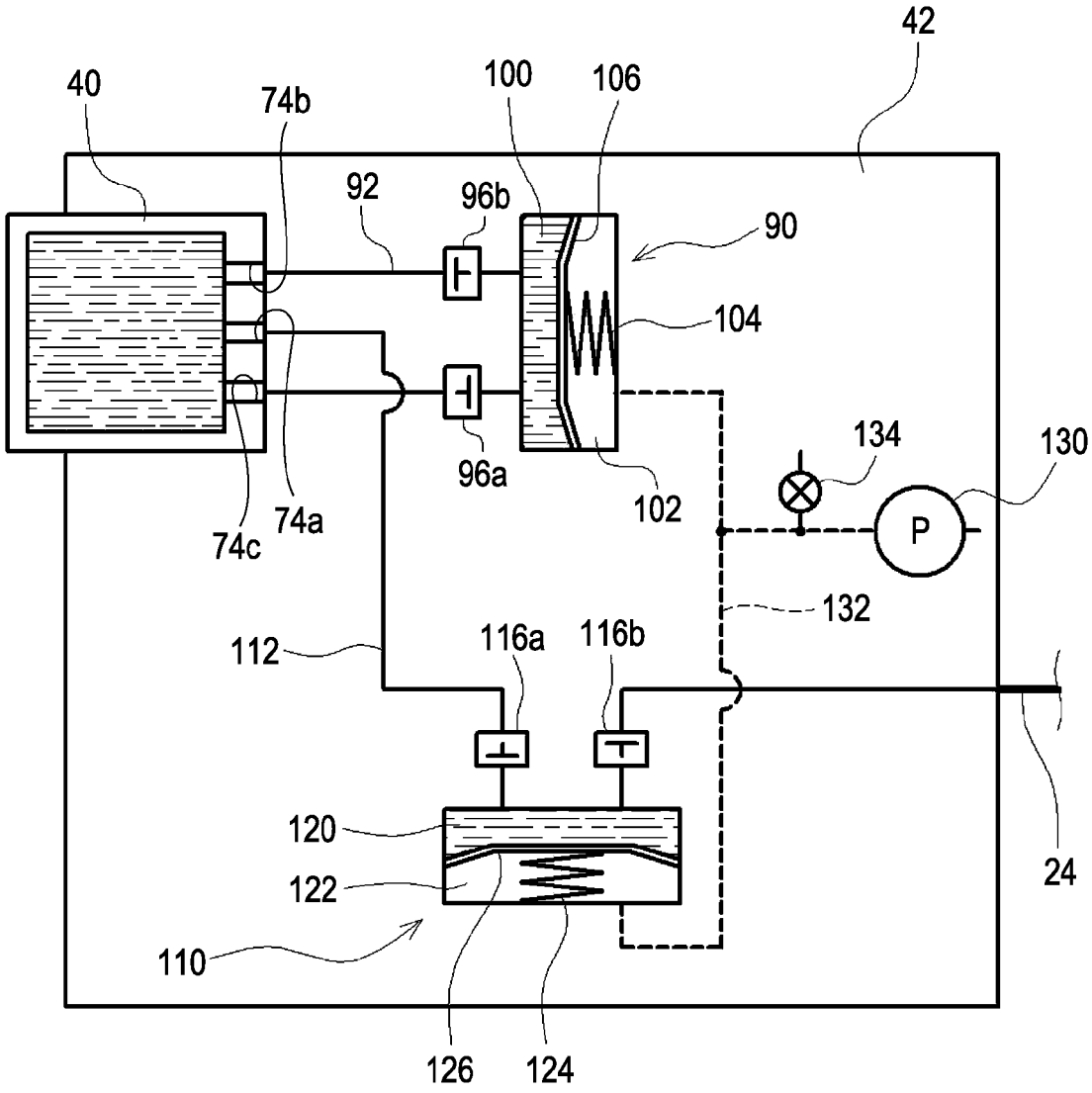
FIG. 5 is an explanatory view showing a driving mechanism of a liquid-feeding pump and a circulation pump of the embodiment.

B. Driving Mechanism of Circulation Pump and Liquid-feeding Pump of the Present Embodiment FIG. 5 is an explanatory view showing the mechanism that drives the circulation pump 90 and the liquid-feeding pump 110 of the embodiment. The inner portion of the liquid-feeding pump 110 of the embodiment is separated into an ink chamber 120 and an air chamber 122 by a diaphragm 126, and a holding spring 124 is installed so as to hold the diaphragm 126 to a predetermined shape in the air chamber 122. Moreover, in the supplying pathway 112 that connects the ink chamber 120 of the liquid-feeding pump 110 and the ink supplying port 74*a* of the ink cartridge 40, an upward flow-prevention valve 116*a* is installed. A downward flow-prevention valve 116*b* is installed in the supplying pathway 112 that connects the ink chamber 120 and the ink tube 24.

In addition, similarly to the liquid-feeding pump 110, the inner portion of the circulation pump 90 is separated into an ink chamber 100 and an air chamber 102 by a diaphragm 106, and a holding spring 104 of the diaphragm 106 is installed in the air chamber 102. In addition, in the circulation pathway 92 that connects the ink chamber 100 of the circulation pump 90 and the ink suction port 74*c* of the ink cartridge 40, an upward flow-prevention valve 96*a* is installed. A downward flow-prevention valve 96*b* is installed in the circulation pathway 92 that connects the ink chamber 100 and the ink discharging port 74*b*.

In addition, the air chamber 122 of the above-described liquid-feeding pump 110 and the air chamber 102 of the circulation pump 90 are connected to the a decompression pump 130 via a decompression pathway 132, and in the decompression pathway 132 of at least the upstream side of the decompression pump 130, an atmosphere release valve 134 for introducing the atmosphere to the decompression pathway 132 is installed.

The driving mechanism of the liquid-feeding pump 110 and the circulation pump 90 constituted as above drives the liquid-feeding pump 110 and the circulation pump 90 as follows. First, the decompression pump 130 is driven in a state where the atmosphere release valve 134 is closed. Thereby, the inner portion of the air chamber 122 of the liquid-feeding pump 110 is depressurized, and the inner portion of the air chamber 102 of the circulation pump is depressurized. Therefore, the diaphragm 126 of the liquid-feeding pump 110 is deformed against the spring force of the holding spring 124, and the volume of the ink chamber 120 is increased. In addition, the diaphragm 106 of the circulation pump 90 is deformed against the spring force of the holding spring 104, and the volume of the ink chamber 100 is also increased.

At this case, in the liquid-feeding pump 110 side, according to the increase in the volume of the ink chamber 120, the upward flow-prevention valve 116*a* installed in the supplying pathway 112 is opened, and the downward flow-prevention valve 116*b* installed in the supplying pathway 112 is closed. Therefore, ink flows from the ink supplying port 74*a* of the ink cartridge 40 into the ink chamber 120. Moreover, in the circulation pump 90 side, according to the increase in the volume of the ink chamber 100, the upward flow-prevention valve 96*a* installed in the circulation pathway 92 is opened, and the downward flow-prevention valve 96*b* installed in the circulation pathway 92 is closed. Therefore, ink flows from the ink suction port 74*c* of the ink cartridge 40 into the ink chamber 100.

From the above state, by opening the atmosphere release valve 134 installed in the decompression pathway 132, the atmosphere is introduced into the decompression pathway 132. Thereby, the atmosphere is introduced into the air chamber 122 of the liquid-feeding pump 110, and the atmosphere is also introduced into the air chamber 102 of the circulation pump 90. Therefore, the diaphragm 126 of the liquid-feeding pump 110 is returned to the original position by the spring force of the holding spring 124, and the diaphragm 106 of the circulation pump 90 is also returned to the original position by the spring force of the holding spring 104.

At this case, in the liquid-feeding pump 110 side, in a state where the ink is ejected from the ejection nozzle, the ink in the ink chamber 120 is pushed out to the supplying pathway 112 through the force by which the diaphragm 126 is returned to the original position. According to this, the upward flow-prevention valve 116*a* of the supplying pathway 112 is closed, and the downward flow-prevention valve 116*b* is opened. Therefore, the ink is pressure-fed from the ink chamber 120 to ink tube 24, and as a result, the ink is supplied to the ejection nozzle by the amount which is ejected. In addition, if the ink is not ejected from the ejection nozzle, the diaphragm 126 is not returned to the original position. Accordingly, the ink in the ink chamber 120 is not pressure-fed to the ink tube 24. Moreover, in the circulation pump 90 side, the ink in the ink chamber 100 is pushed out to the circulation pathway 92 by the diaphragm 106. At this case, the upward flow-prevention valve 96*a* of the circulation pathway 92 is closed, and the downward flow-prevention valve 96*b* is opened. Therefore, the ink is pressure-fed from the ink chamber 100 to the ink discharging port 74*b*.

In addition, if the atmosphere release valve 134 is closed from the above state, the two air chambers (air chamber 102 and air chamber 122) are depressurized again. Therefore, the diaphragm 106 of the circulation pump 90 and the diaphragm 126 of the liquid-feeding pump 110 are deformed, and the ink is introduced from the ink cartridge 40 to the ink chamber 120 of the liquid-feeding pump 110, and the ink is introduced to the ink chamber 100 of the circulating pump 90. Moreover, if opening the atmosphere release valve 134, the diaphragm 126 of the liquid-feeding pump 110 tries to return to the original position. Therefore, the ink is pressure-fed from the ink chamber 120 to the ink tube 24, and the ink is pressure-fed from the ink chamber 100 to the ink cartridge 40 by the diaphragm 106 of the circulation pump 90. By repeating the similar operations, the ink, which is sucked out from the inner portion of the ink cartridge 40 by the liquid-feeding pump 110, are pressure-fed to the ejection head 20, and the ink in the cartridge 40 is agitated by the circulation pump 90.

If the driving mechanism of the circulation pump 90 and the liquid-feeding pump 110 of the above-described embodiment are used, the two pumps (circulation pump 90 and liquid-feeding pump 110) can be driven by using same decompression pump 130 as a driving source. Thereby, even though the circulation pump 90 for agitating the ink in the ink cartridge 40 is added, the driving mechanism for driving the circulation pump 90 need not be provided additionally. As a result, it is possible to suppress the complication of the configuration of the ink jet printer 10 while being capable of agitating the inner portion of the ink cartridge 40.

In addition, according to the above-described driving mechanism of the circulation pump 90 and the liquid-feeding pump 110, the circulation pump 90 is also driven during pressure-feeding the ink to the ejection head 20 by the liquid-feeding pump 110. Accordingly, the inner portion of the ink cartridge 40 is necessarily agitated during performing the printing, it is possible to perform the agitation of the ink at an appropriate timing (that is, at time of printing) even without performing a special control. In addition, as described below, the above-described agitating operation in the inner portion of the ink cartridge 40 is also performed in the ink cartridge 40 of the ink which is not ejected currently.

Figure 6:
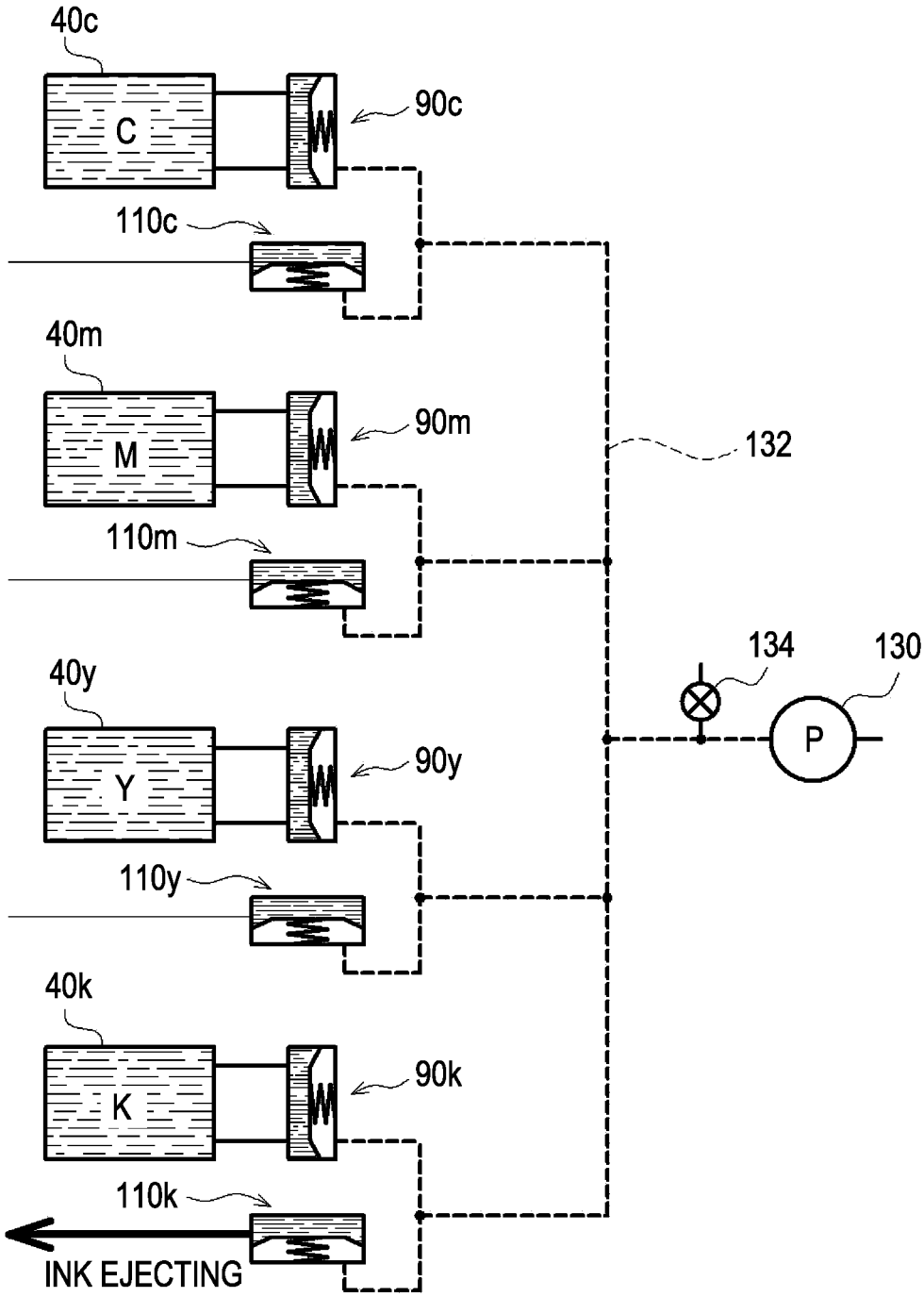
FIG. 6 is an explanatory view showing an appearance in which an ink agitating operation is performed even in ink cartridges of inks which are not ejected.

FIG. 6 is an explanatory view showing an appearance in which the ink agitating operation is performed even in the ink cartridges 40 of the inks which are not ejected. In FIG. 6, to each of the four kinds of the ink cartridges 40 (ink cartridges 40*c*, 40*m*, 40*y* and 40*k*) mounted on the ink jet printer 10 of the embodiment, the liquid-feeding pump 110 and the circulation pump 90 are installed. In addition, the liquid-feeding pump 110 (liquid-feeding pumps 110*c*, 110*m*, 110*y* and 110*k*) or the circulation pump 90 (circulation pumps 90*c*, 90*m*, 90*y* and 90*k*) are connected to the decompression pump 130 via the decompression pathway 132 indicated as broken lines.

As shown in FIG. 6, the decompression pump 130 of the embodiment is connected to all liquid-feeding pumps (liquid-feeding pumps 110*c*, 110*m*, 110*y*, and 110*k*) and all circulation pumps (circulation pumps 90*c*, 90*m*, 90*y*, and 90*k*) in parallel via the decompression pathway 132. Accordingly, for example, as shown by an arrow of a bold line, if ejecting the black ink by driving the liquid-feeding pump 110*k* of the black ink, all liquid-feeding pumps 110 and all circulation pumps 90, which are connected to the decompression pump 130, are driven simultaneously. Accordingly, in a state where any one of the inks is ejected from the ejection head 20, the inks are agitated by the circulation pumps 90 even in the ink cartridges 40 of the inks which are not ejected currently. Therefore, the ink sedimentation proceeding can be suppressed even in the ink cartridges 40 of the inks which are not ejected, and when performing the printing by using the inks, it is possible to effectively suppress the adverse effect which occurs due to the sedimentation of the ink. Particularly, according to the configuration shown in FIG. 6, if driving the liquid-feeding pump 110*k* of the black ink, the liquid-feeding pumps (the liquid-feeding pumps 110*c*, 110*m* and 110*y*) of the inks of other colors also are driven. However, as described in FIG. 5, in the liquid-feeding pumps 110 of the inks which are not ejected, the inks are not pressure-fed to the ejection nozzles even when the liquid-feeding pumps 110 are driven. Accordingly, the inks are not supplied to the ejection head 20 to which the ink need not be supplied.

In addition, in the ink cartridge 40 of the embodiment, from the lower side of the ink cartridge 40 to upper side of the ink cartridge 40, the ink suction port 74*c*, the ink supplying port 74*a*, and the ink discharging port 74*b* are installed in the above order. The order is determined so as to finish up the ink by sucking out the ink without wasting the ink in the ink pack 70 while efficiently agitating the ink in the ink cartridge 40. The above-described points will be described below.

First, from the viewpoint of efficiently agitating the ink in the ink pack 70, when agitating in the ink cartridge 40, it is necessary to generate the flow of the ink uniformly. Accordingly, it is preferable that either one of the ink suction port 74*c* and the ink discharging port 74*b*, which are related to the ink agitation, is provided in the upper portion of the ink cartridge 40, and the other one is installed in the lower portion. At this case, the ink supplying port 74*a* is provided in the middle of the ink cartridge 40.

On the other hand, from the viewpoint of finishing up the ink without wasting the ink in the ink pack 70, since the ink in the ink pack 70 is easily collected in the lower side of the pack, in general, it is preferable that the ink supplying port 74*a* is installed in the lower side of the ink cartridge 40 as far as possible. However, in the ink jet printer 10 of the embodiment, even though the ink supplying port 74*a* is slightly highly positioned (the middle), it is possible to finish up the ink without wasting the ink in the ink pack 70 for the following reasons.

Figure 7A:
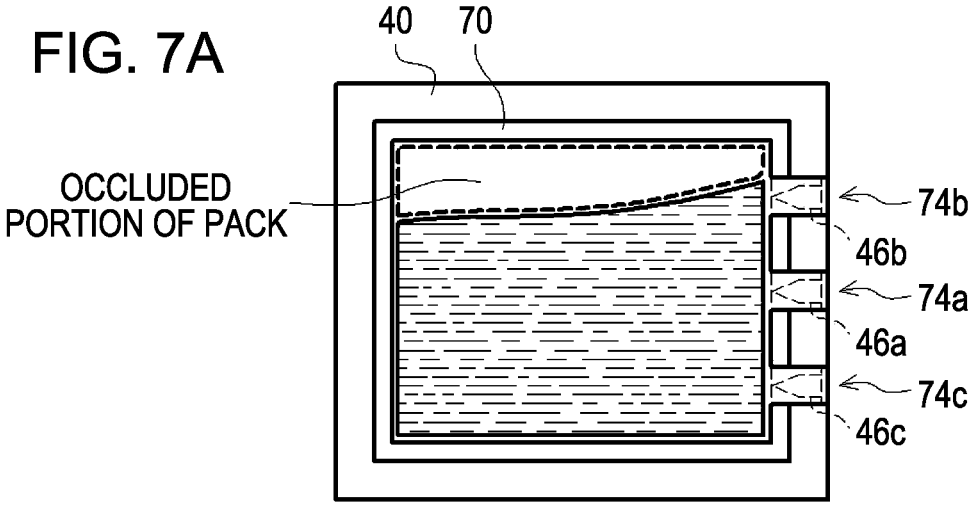
FIGS. 7A to 7C is an explanatory view showing the basis for being capable of sucking out the ink without wasting the ink in an ink cartridge.
Figure 7B:
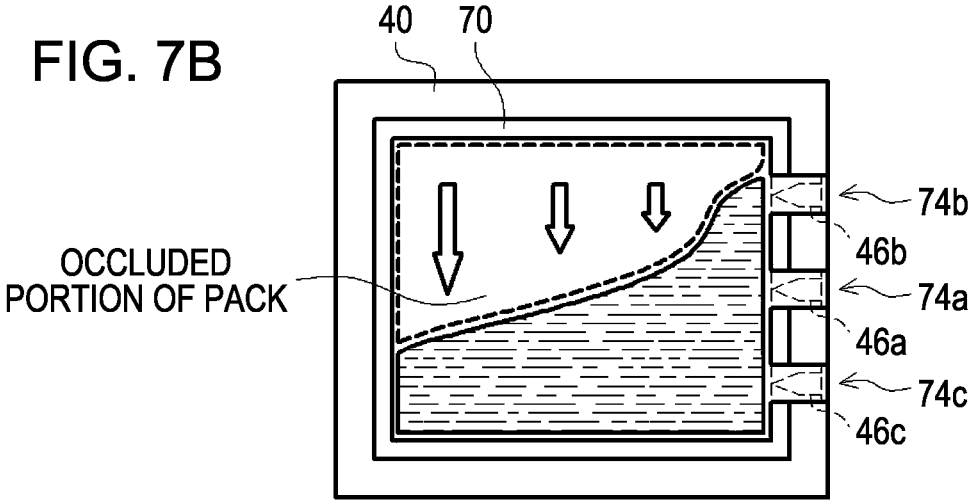
Figure 7C:
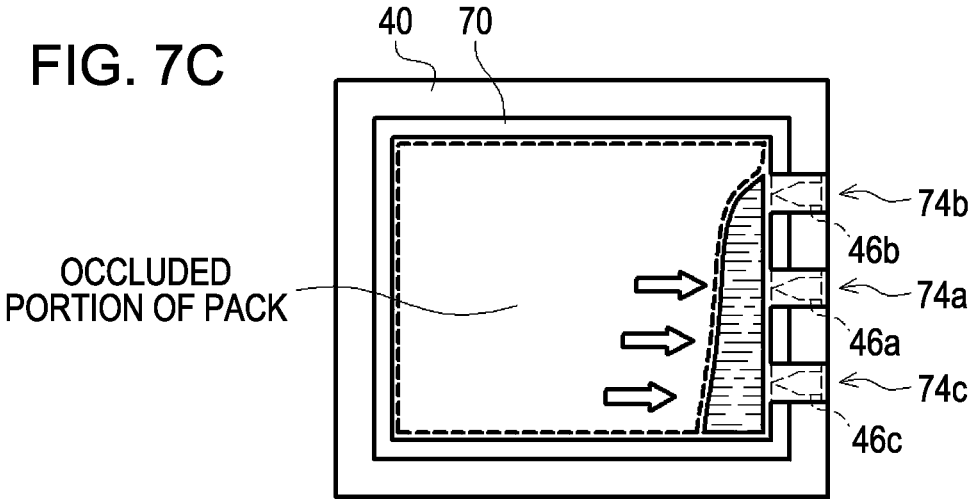

FIGS. 7A to 7C are explanatory views showing the basis for being capable of sucking out the ink without wasting the ink in the ink cartridge 40. If the ink in the ink cartridge 40 is consumed, the ink amount of the ink pack 70 is decreased, and therefore, a portion in which the ink pack 70 is crushed (hereinafter, referred to as an occluded portion) is formed. As shown in FIG. 7A, the occluded portion is formed from above the ink pack 70. In addition, as the ink in the ink pack 70 is consumed, the occluded portion is gradually expanded downward as shown in FIG. 7B. At this case, as described above, in the state where the ink is supplied to the ejection head 20, the ink in the ink cartridge 40 is circulated by the circulation pump 90 (refer to FIG. 4). Therefore, the ink sucked out from the ink suction port 74*c* is continuously discharged from the ink discharging port 74*b*. Thereby, even when the occluded portion of the ink pack 70 is considerably expanded, as shown in FIG. 7C, a portion, in which the ink discharged from the ink discharging port 74*b* flows until the lower ink suction port 74*c*, is not occluded to the end. Moreover, since the ink supplying port 74*a* is positioned between the ink discharging port 74*b* and the ink suction port 74*c*, the occluded portion does not occur to the end. Therefore, it is possible to suck out the ink to the end without wasting the ink in the ink pack 70.

C. Modification

With respect to the above-described embodiment, some modifications are considered. Hereinafter, the modifications will be briefly described. In addition, in the modifications described below, with respect to the parts similar to those of the above-described embodiment, similar reference numbers are denoted, and the description thereof is omitted.

C-1. First Modification

In the above-described embodiment, the agitation operation of the ink in the ink cartridge 40 is performed when the ink of any color is ejected from the ejection head 20. However, before the ink is ejected, in the state where the ink is not ejected, at the short interval, the circulation pump 90 may be driven by using the decompression pump 130.

As described above, in the ink jet printer 10 of the embodiment, in the state where the ink is not ejected, the unneeded ink is not supplied to the ejection nozzle by the liquid-feeding pump 110 even though the decompression pump 130 is driven (refer to FIG. 5). Thereby, in the state where the ink is not ejected, at the short interval, through driving the circulation pump 90 by using the decompression pump 130, it is possible to start the printing while previously agitating the ink in the ink cartridge 40 before ejecting the ink. Therefore, for example, the printing is not performed for an extremely long time, and even when the agitation of the ink in the ink cartridge 40 is not performed, or the like, and even when the ink in the ink cartridge 40 is considerably sedimented, or the like, it is possible to start the printing after sufficiently agitating the ink. Thereby, since the ink is agitated by the circulation pump 90 during the ejection of the ink, it is possible to reliably avoid the adverse effect which occurs due to the sedimentation of the ink during the printing.

C-2. Second Modification

In the above-described embodiment and the first modification, the liquid-feeding pump 110 and the circulation pump 90 are driven by depressurizing the air chambers (the air chambers 122 and 102) of the inner portions of the pumps through the use of the decompression pump 130. However, the liquid-feeding pump 110 and the circulation pump 90 may be driven as follows.

Figure 8:
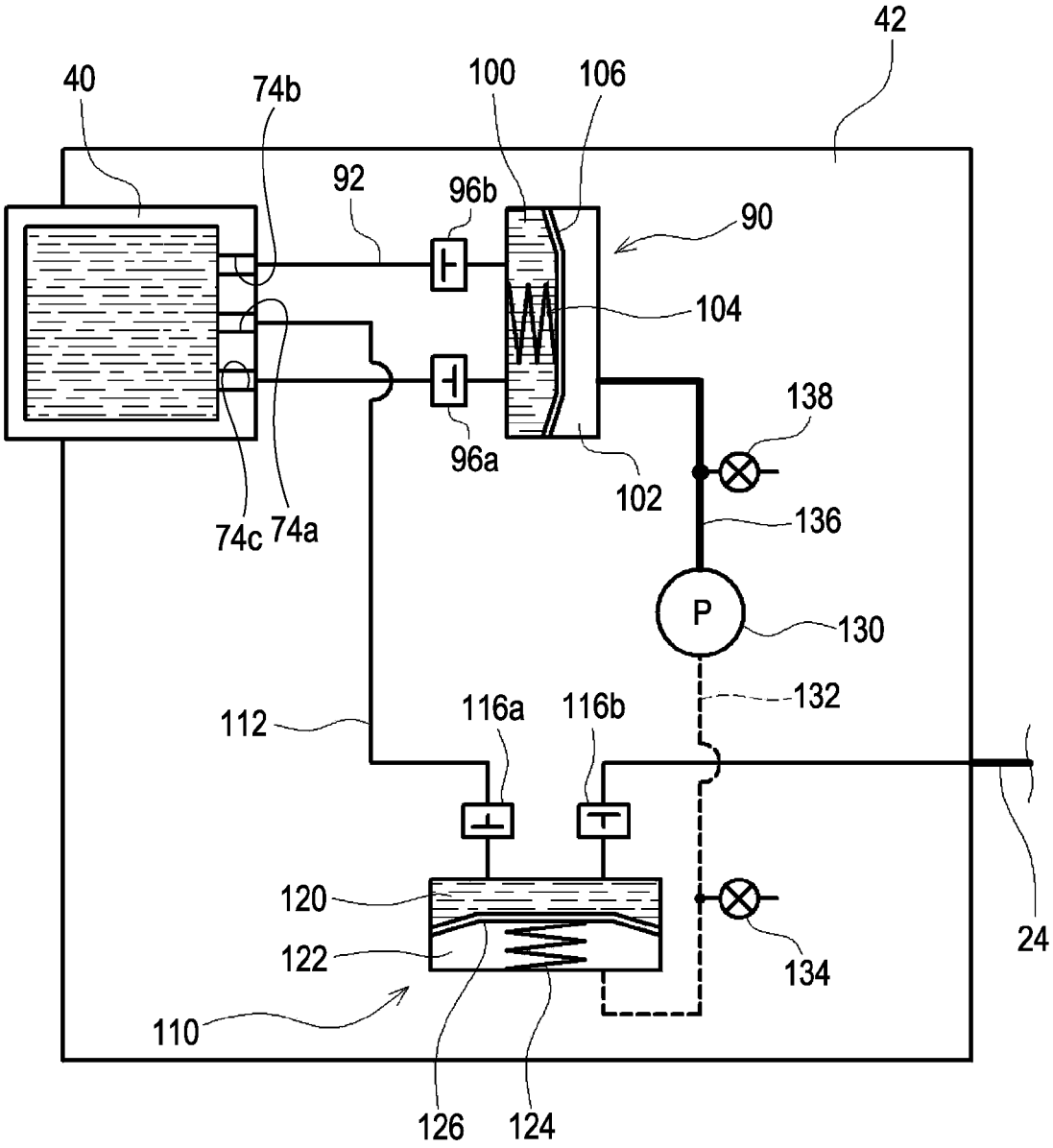
FIG. 8 is an explanatory view showing a driving mechanism of a circulation pump and a liquid-feeding pump of a second modification.

FIG. 8 is an explanatory view showing a driving mechanism of the liquid-feeding pump 110 and the circulation pump 90 of the second modification. The driving mechanism of the liquid-feeding pump 110 and the circulation pump 90 of the second modification is different to the above-described driving mechanism of FIG. 5 as follows. That is, the decompression pathway 132, which introduces the negative pressure generated in the decompression pump 130, is connected to the air chamber 122 of the liquid-feeding pump 110. However, the decompression pathway 132 is not connected to the air chamber 102 of the circulation pump 90. Instead of this, the decompression pump 130 and the circulation pump 90 are connected to each other by the compression pathway 136, and the exhaust, which is generated when driving the decompression pump 130, is supplied to the air chamber 102 through the decompression pathway 136. In addition, in the compression pathway 136, an atmosphere release valve 138, which is separate to the atmosphere release valve 134 installed in the above-described decompression pathway 132, is installed. Moreover, the holding spring 104 of the diaphragm 106 of the circulation pump 90 side is installed in the ink chamber 100 not in the air chamber 102.

In the driving mechanism of the liquid-feeding pump 110 and the circulation pump 90 of the second modification described above, two pumps (liquid-feeding pump 110 and circulation pump 90) are driven as follows. That is, if driving the decompression pump 130 in a state of closing the two atmosphere release valves (atmosphere release valve 134 and atmosphere release valve 138), the diaphragm 126 is deformed in the liquid-feeding pump 110 side, the ink chamber 120 is expanded, and the ink flows into the ink chamber 120 from the ink cartridge 40. On the other hand, if driving the decompression pump 130, air in the pump is discharged from an exhaust port (not shown) of the decompression pump 130, and the air is supplied to the air chamber 102 of the circulation pump 90 side through the compression pathway 136. Therefore, the inner portion of the air chamber 102 is pressurized. Thereby, the diaphragm 106 is deformed against the spring force of the holding spring 104 in the ink chamber 100, and the ink chamber 100 is compressed. Therefore, the ink in the ink chamber 100 is pressure-fed to the ink discharging port 74*b* of the ink cartridge 40.

From the above state, if opening the two atmosphere release valves (atmosphere release valve 134 and atmosphere release valve 138), the atmosphere is introduced to the decompression pathway 132, and the air pressurized from the compression pathway 136 is flowed out. As a result, the diaphragm 126 is returned to the original position in the liquid-feeding pump 110 side, and the ink in the ink chamber 120 is pressure-fed to the ink tube 24. On the other hand, in the circulation pump 90 side, since the pressure in the air chamber 102 is returned to the atmospheric pressure, the pressing force applied to the diaphragm 106 is decreased, the diaphragm 106 is returned to the original position by the spring force of the holding spring 104, and the size of the ink chamber 100 is also returned to the original size. Therefore, the ink flows from the ink suction port 74*c* of the ink cartridge 40 into the ink chamber 100. In addition, if closing the two atmosphere release valves (atmosphere release valve 134 and atmosphere release valve 138), the air chamber 122 of the liquid-feeding pump 110 is depressurized, and the air chamber 102 of the circulation pump 90 is pressurized. Therefore, the ink flows from the ink cartridge 40 into the ink chamber 120 of the liquid-feeding pump 110, and the ink in the ink chamber 100 of the circulation pump 90 is pressure-fed to the ink discharging port 74*b* of the ink cartridge 40.

By repeating the above operations, it is possible to drive the two pumps (liquid-feeding pump 110 and circulation pump 90) by using the decompression pump 130. In addition, according to the driving mechanism of the liquid-feeding pump 110 and the circulation pump 90 of the second modification, compared to the driving mechanism of the liquid-feeding pump 110 and the circulation pump 90 described above (refer to FIG. 5), it is possible to obtain beneficial effect as follows.

Figure 9:
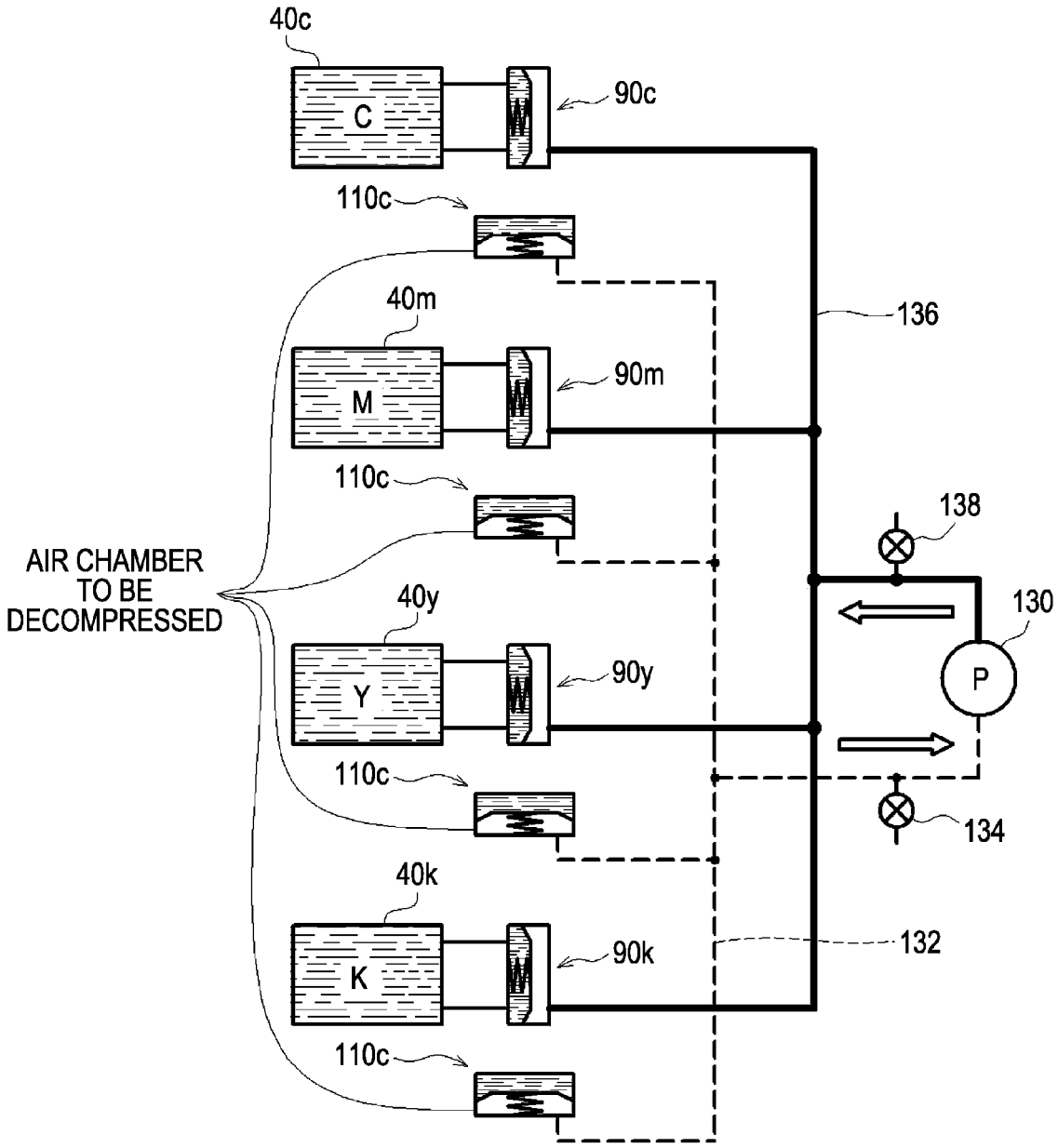
FIG. 9 is an explanatory view showing a beneficial effect which can be obtained through the driving mechanism of the liquid-feeding pumps and the circulation pumps of the second modification.

FIG. 9 is an explanatory view showing a beneficial effect which can be obtained by using the driving mechanisms of the liquid-feeding pump 110 and the circulation pump 90 of the second modification. In FIG. 9, it is illustrated that the liquid-feeding pump 110 (liquid-feeding pumps 110*c*, 110*m*, 110*y*, and 110*k*) and the circulation pump 90 (circulation pumps 90*c*, 90*m*, 90*y*, and 90*k*) are mounted on the ink jet printer 10 of the second modification. In addition, the decompression pathway 132, which connects the liquid-feeding pump 110 and the decompression pump 130, is shown as a broken line. The compression pathway 136, which connects the circulation pump 90 and the decompression pump 130, is shown as a bold line.

In the driving mechanism of the liquid-feeding pump 110 and the circulation pump 90 of the second modification, as described above, the air chamber to be depressurized by using the decompression pump 130 is only the air chamber 122 of the liquid-feeding pump 110. Therefore, the air chamber 102 of the circulation pump 90 need not be depressurized (refer to FIG. 8). Accordingly, as shown in FIG. 9, even when the number of the liquid-feeding pumps 110 and the circulation pumps 90 to be installed is increased due to the fact that a plurality of ink cartridges 40 is mounted, only the air chamber 122 of the liquid-feeding pump 110 may be depressurized, and the circulation pump 90 can be driven through the exhaust which is generated by operating the negative pressure in the liquid-feeding pump 110. Therefore, since the number of the air chambers to be depressurized is decreased by half, the volume of the decompression pump 130 can be made small. As a result, miniaturization of the ink jet printer 10 can be achieved.

In addition, in the driving mechanism of the liquid-feeding pump 110 and the circulation pump 90 of the above-described second modification, the air chamber that is depressurized by using the decompression pump 130 and the air chamber that is pressurized by the exhaust of the decompression pump 130 may be reversed to each other. That is, the air chamber 102 of the circulation pump 90 side may be depressurized by the decompression pump 130, and the air chamber of the liquid-feeding pump 110 side may be pressurized by using the exhaust of the decompression pump 130. Therefore, also according to the method for driving the liquid-feeding pump 110 and the circulation pump 90, it is possible to obtain a similar beneficial effect to the above-described case.

Hereinbefore, various embodiments are described. However, the invention is not limited to the above-described embodiments, and it is possible to perform various aspects within a scope which does not depart from the gist of the invention. For example, in the above-described embodiments and modifications, the ink jet printer in which a so called pigment ink is mounted is explained as an example. However, the invention can be appropriately applied to an ink jet printer in which ink (for example, ink such as white ink or metallic ink) including components, which are easily sedimented in the ink, is mounted. In addition, in the above-described embodiments and modifications, the ink suction port is installed below the side surface of the ink cartridge, and the ink discharging port is installed above the side surface of the ink cartridge. However, the positions of the ink supplying port and the ink discharging port may be reversed to each other.

What is claimed is:

1. A liquid ejecting apparatus that ejects a liquid from an ejection nozzle, the liquid ejecting apparatus including:

a liquid container that stores the liquid to be supplied to the ejection nozzle;

a liquid-feeding pump that feeds the liquid, which is sucked out from the liquid container, into the ejection nozzle;

a decompression pump that generates pressure for operating the liquid-feeding pump;

a circulation pathway in which both ends of the circulation pathway are opened to the liquid container; and a circulation pump that is provided in the circulation pathway, discharges the liquid sucked out from the liquid container to the liquid container, and is operated by the pressure generated through the decompression pump.

2. The liquid ejecting apparatus according to claim 1, wherein the circulation pathway is a pathway in which both ends of the circulation pathway are opened at different heights in the liquid container, the circulation pump is a pump that sucks out the liquid from the side opened to the lower end of both ends of the circulation pathway, and discharges the liquid from the side opened to the higher end of both ends of the circulation pathway, and the liquid-feeding pump is a pump that sucks out the liquid from a height between the positions in which both ends of the circulation pathway are opened to the liquid container and that feeds the liquid into the ejection nozzle.

3. The liquid ejecting apparatus according to claim 1, wherein the decompression pump is a pump that operates any one of the liquid-feeding pump or the circulation pump by a negative pressure which is generated by the decompression pump, and that operates the other one of the liquid-feeding pump or the circulation pump by the pressure of air which is discharged from the decompression pump at time of generating the negative pressure by the decompression pump.

* * * * *